United States Patent [19]

Chiappe

[11] 3,997,075

[45] Dec. 14, 1976

[54] NON-DETACHABLE END UNIT

[75] Inventor: Wayne T. Chiappe, Hinsdale, Ill.

[73] Assignee: Continental Can Company, Inc., New York, N.Y.

[22] Filed: Nov. 13, 1975

[21] Appl. No.: 631,572

Related U.S. Application Data

[63] Continuation of Ser. No. 546,847, Feb. 3, 1975, abandoned.

[52] U.S. Cl. ..... 220/268; 220/277

[51] Int. Cl.[2] ..... B65D 41/32

[58] Field of Search ..... 220/268–273, 220/277

[56] References Cited

UNITED STATES PATENTS

| | | | |
|---|---|---|---|
| 3,401,822 | 9/1968 | Fraze | 220/273 |
| 3,952,912 | 4/1976 | Perry | 220/269 |

*Primary Examiner*—George T. Hall

*Attorney, Agent, or Firm*—Joseph E. Kerwin; John J. Kowalik; William A. Dittmann

[57] ABSTRACT

An improved non-detachable end closure wherein a pull tab member initiates fracture of the opening score line. The pull tab member is fastened to the end panel with the pull tab nose portion resting on a raised bead formed on the opening flap member immediately adjacent the score line. The tab member is preloaded with a panelward force directed against the flap member, said force serving to reduce the effort required to fracture the score. Opening of the container is accomplished by lifting the tab member to initiate fracture of the score. The flap member remains attached to the end panel and is pushed into the container with finger or thumb pressure.

15 Claims, 3 Drawing Figures

NON-DETACHABLE END UNIT

This is a continuation of application Ser. No. 546,847, filed Feb. 3, 1975, now abandoned.

SUMMARY OF THE INVENTION

The present invention relates to containers and the like and is particularly concerned with containers having easy-open closure means.

The usual easy-opening container has a flap or tear strip formed in a container wall. A tab is secured directly to the flap and upon lifting of the tab, the flap is completely severed from the container wall to form an opening therein. The tab and flap are relatively small and are frequently carelessly discarded following their removal from the container. The container may also be discarded when empty; however, because the container is relatively large, it can be easily collected for disposal. On the other hand, the tabs and flaps, being quite small are often ignored or overlooked causing a litter problem, the magnitude of this problem is increasing due to the constantly increasing usuage of easy-opening containers.

The litter created by the tabs and flaps creates an especially acute problem at recreational areas such as parks and beaches, particularly because conventional devices for picking up litter do not pick up the tabs and flaps. As a result, they continue to accumulate. For this reason, ordinances have been enacted in some areas to bar easy-opening containers where the tab and flap separate from the container body.

It is, therefore, the primary objective of the present invention to provide an improved easy-open closure which reduces litter by retaining the tab and flap attached to the container after opening.

It is a further objective to provide an improved easy-open closure which may be opened with a minimum of effort.

BRIEF DESCRIPTION OF THE DRAWINGS

With the above and other objects in view that will hereinafter appear, the nature of the invention will be more clearly understood by reference to the following specifications when viewed in light of the accompanying drawing, in which.

DESCRIPTION OF THE PREFERRED EMBODIMENT

Figure 1:
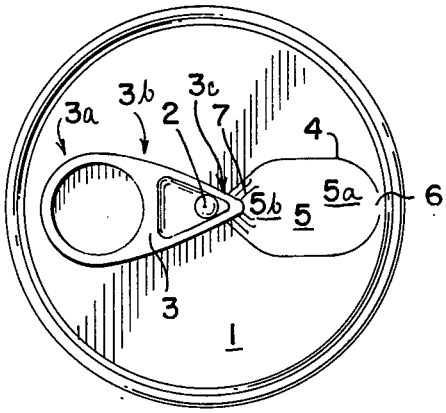
FIG. 1 is a top plan view of the improved end closure of the present invention.
Figure 2:
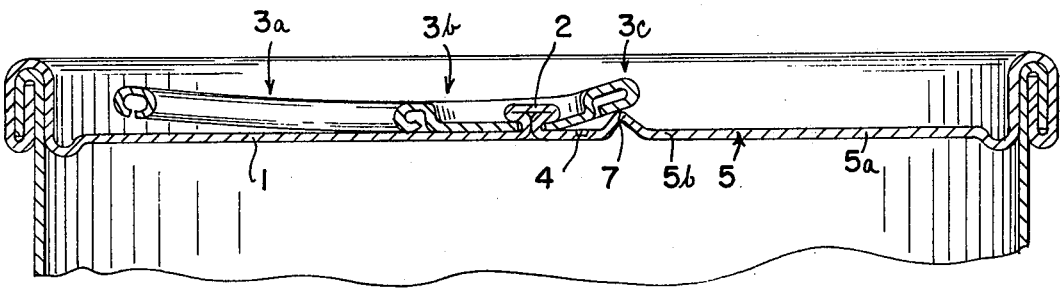
FIG. 2 is a cross-sectional view taken substantially along line 1—1 of FIG. 1.
Figure 3:
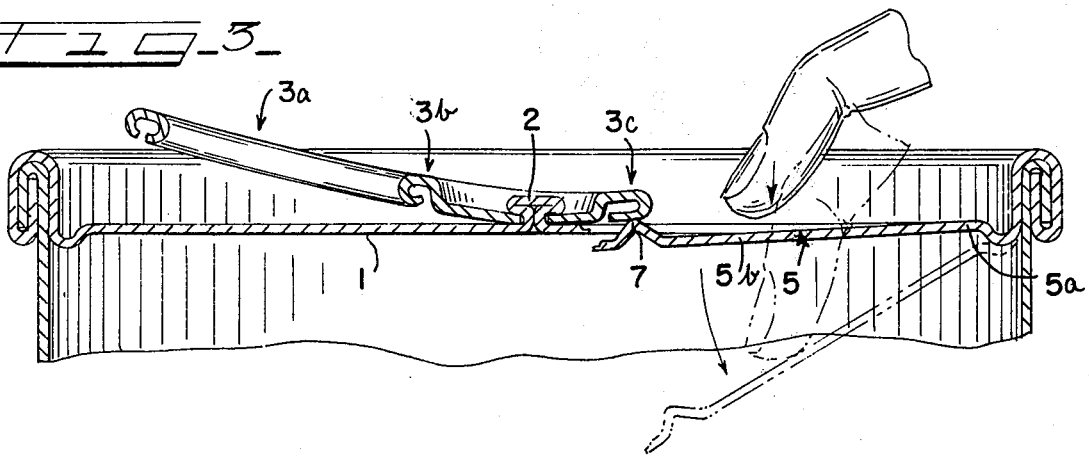
FIG. 3 is a cross-sectional view similar to FIG. 2, illustrating the application of finger pressure to complete opening of the closure.

As shown in the drawings, the improved easy-open closure of this invention comprises an end panel 1, a rivet 2 integrally formed in said end panel 1 and a pull tab member 3 fixedly attached to said end panel 1 by said rivet 2. A score line 4 is formed in said end panel 1 and defines an opening flap member 5 therein.

The opening flap member 5 is ovoid in shape, having a substantially rounded end 5*a* and a substantially pointed end 5*b* with a raised bead 7. The flap member 5 is symmetrically disposed with relation to a diameter of the end panel 1, the pointed end 5*b* being nearer the center of the end panel 1. A portion 6 of the flap perimeter immediately adjacent the end panel perimeter is unscored, with the unscored portion 6 serving to integrally attach the flap member 5 to the end panel 1 after the score line 4 has been fractured and the container opened.

The pull tab member 3 comprises a finger ring portion 3*a* an intermediate portion 3*b* and a nose portion 3*c*. The nose portion 3*c* overlies a portion of the score line 4 and rests on the top of the bead 7. During the staking operation, wherein the tab member 3 is fastened to the end panel 1, the intermediate portion 3*b* is forced downwardly onto the end panel 1, thereby panelwardly biasing the nose portion 3*c* and impressing a downward force on pointed ends 5*b* of the flap member 5 in the area immediately adjacent the score line 4. This biasing force reduces the additional force necessary to fracture the score 4 for opening the container.

The finger ring portion 3*a* is also panelwardly biased and thereby maintained in close contact with the end panel 1. Undesirable tab protrusion is thus prevented.

Opening of the closure is accomplished by a 2-step process, the first step comprises lifting of the finger ring member 3*a*, causing the tab member 3 to rotate vertically about the rivet 2. This rotation forces the nose portion 3*c* panelwardly against the bead 7 and results in fracture of the score 4 immediately adjacent the bead 7. The nose portion 3*c* overlying the fractured portion of the score 4 serves to shield the fracture area during venting of the container. The second step comprises application of finger or thumb pressure to the flap member 5 causing controlled tearing of the end panel 1 along the score 4 and further causing the flap member 5 to be pushed into the container, thereby establishing an unobstructed opening in the end panel 1.

Fracture of the score 4 may be accomplished with a limited displacement of the finger ring member 3*a*, fracture generally occurring when the angle between the end panel 1 and the tab 3 approaches 30°. This limited displacement prevents the tab member 3 from interfering with access to the opened flap area after opening is completed.

I claim:

1. An improved easy-open end closure for use on a can or similar container comprising an end panel, a score formed in said end panel and terminating in a point and defining an opening flap member therein, a tab member non-removably attached to said end panel and having means for opening said flap member, retention means to retain said flap member attached to said end panel subsequent to opening of said end panel, and localized force preloading and transmission means on at least one of said members at said point for prestressing said flap member toward the end panel and concentrating the opening force from said tab member to said flap member to open said container.

2. An improved easy-open end closure as described in claim 1, wherein said flap retention means comprises an unscored area in the perimeter of said flap member, said flap member thereby remaining integrally attached to said end panel.

3. An improved easy-open end closure as described in claim 2, wherein said unscored area of said flap member perimeter is immediately adjacent the outer perimeter of said end panel.

4. An improved easy-open end closure as described in claim 3, wherein said flap member is ovoid in shape with one end substantially rounded and the other substantially pointed, said flap member being symmetrically disposed with relatio n to a diameter of said end panel with said pointed end nearest the end panel center.

5. An improved easy-open end closure as described in claim 2, wherein said force preloading and transmission means comprises a raised bead formed in a portion of said flap member nearest the center of said end panel and a portion of said tab member rests on said bead.

6. An improved easy-open end closure as described in claim 5, wherein said tab member is attached to said end panel by rivet means integrally formed in said end panel, said rivet means drawing said tab member toward said end panel and loading said tab member with a bending moment.

7. An improved easy-open end closure as described in claim 6, wherein said bead maintains said opening means in spaced relation with said end panel.

8. An improved easy-open end closure as described in claim 7, wherein said bending moment panelwardly biases said opening means on said tab member.

9. An improved easy-open end closure as described in claim 8, wherein said tab member comprises a finger ring portion, an intermediate portion, and a nose portion, and said nose portion overlies the portion of said score immediately adjacent said bead in shielding relation.

10. An improved easy-open end closure as described in claim 9 wherein opening of said closure comprises a 2-step process, the first step comprising lifting of said finger ring portion to fracture the portion of said score immediately adjacent said bead, the second step comprising application of finger or thumb pressure to said flap member causing controlled tearing of said end panel along said score partially separating said flap member from said end panel and further causing said flap member to be pushed into said container, thereby establishing an unobstructed opening in said end panel.

11. An improved easy-open end closure as described in claim 2, wherein said flap member is elongated in shape with said unscored area at one end of said flap member and said tab member non-removably attached to said end panel adjacent the other end.

12. An end closure for a can or similar container comprising an end panel, a score formed in said end panel and partially encircling an opening flap member, the unscored portion of the flap periphery serving as a hinge whereby said flap is non-removably attached to said end panel, a tab member non-removably attached to said end panel and having a finger ring portion and means for opening said flap member, said opening means overlying a portion of said flap member and a raised bead formed in said flap member beneath said opening means, said rivet drawing said tab member panelwardly whereby said opening means is biased against said bead and said finger ring portion is biased against said end panel.

13. An end closure for a can or similar container comprising an end panel, a score formed in said end panel and partially encircling an opening flap member, the unscored portion of the flap periphery serving as a hinge whereby said flap is non-removably attached to said end panel, a tab member non-removably attached to said end panel and having a lift portion and means for opening said flap member, said opening means overlying a portion of said flap member, and a small raised bead formed in said flap member and positioned entirely beneath said opening means for transmitting stress from said tab member directly to an initially limited selected area of score thereby initiating tearing of the score at the area immediately adjacent to said bead for progressive tearing of said score around said flap to said hinge and thereby effecting predetermined movement of said flap member and opening of said closure.

14. An end closure for a can or similar container comprising an end panel, a score formed in said end panel and partially encircling an opening flap member, the unscored portion of the flap periphery serving as a hinge whereby said flap is non-removably attached to said end panel, a tab member nonremovably attached to said end panel and having a lift portion and means for opening said flap member, said opening means overlying a portion of said flap member, said flap member having a portion thereof located adjacent to said opening means and offset with respect to adjacent portions of said flap, said offset portion underlying said tab, and being substantially covered thereby, for transmitting through said members an opening force from said tab member directly to a initially limited selected area of the score thereby initiating tearing of the score at the area immediately adjacent said offset portion for progressive tearing of said score around said flap and thereby effecting predetermined movement of said flap member and opening of said closure, said hinge being adjacent said offset portion, and said flap member diverging from said hinge.

15. An end closure for a can or similar container comprising an end panel, a score formed in said end panel and partially encircling an opening flap member, the unscored portion of the flap member periphery serving as a hinge non-removably attaching said flap member to the end panel, a tab member having a lift portion at one end and means at the other end for opening said flap member, means comprising a rivet on the end panel securing an intermediate portion of the tab thereto, said opening means overlying a portion of said flap member, one of said members having a portion thereof, of limited extent, offset with respect to the other of said members, located adjacent to said rivet and substantially opposed by the other of said members, said offset portion providing a focal point for concentrating forces from said tab member directly to an initially limited selected area of the score thereby initiating tearing of the score at the area immediately adjacent said offset portion and then progressively tearing said score around said flap member and thereby effecting predetermined movement of said flap into the container and opening of said closure, said hinge being adjacent said offset portion, and said flap member diverging from said hinge.

* * * * *